United States Patent [19]

Skrobisch

[11] Patent Number: 4,796,368

[45] Date of Patent: Jan. 10, 1989

[54] CHANGEABLE DOT DISPLAY ASSEMBLY

[76] Inventor: Alfred Skrobisch, 64 Fulton Blvd., Commack, N.Y. 11725

[21] Appl. No.: 56,438

[22] Filed: Jun. 1, 1987

[51] Int. Cl.[4] ..... G09F 9/00

[52] U.S. Cl. ..... 40/449; 40/447; 340/815.04; 340/815.05; 340/815.24; 340/815.27

[58] Field of Search ..... 40/446, 447, 449, 450; 340/783, 815.04, 815.05, 815.08, 815.26, 815.27

[56] References Cited

U.S. PATENT DOCUMENTS

| | | | |
|---|---|---|---|
| 3,624,941 | 12/1971 | Chantry | 40/449 |
| 4,380,879 | 4/1983 | Seibert | 40/447 |
| 4,531,318 | 7/1985 | Chang et al. | 40/447 |
| 4,577,427 | 3/1986 | Browne | 40/449 |
| 4,615,131 | 10/1986 | Wakatake | 40/449 |
| 4,627,182 | 12/1986 | Weiss | 40/449 |
| 4,706,398 | 11/1987 | Browne et al. | 40/449 |

*Primary Examiner*—Gene Mancene
*Assistant Examiner*—Michael Lynch
*Attorney, Agent, or Firm*—Edward H. Loveman

[57] ABSTRACT

This dot assembly has a three-position rotor carrying dot display means for use as a portion of a matrix of dots in a variable message sign. The assembly has a stator including a support carrying reversely magnetizable separate magnetic cores on which are separate electrically energizable coils. The rotor which is carried by the support has a shaft rotated axially perpendicular to the cores. A permanent magnet on the rotor is adjacent to the cores to interact magnetically with them and rotate the shaft selectively to any one of three rotor positions. A single display disk having a peripheral display edge and two opposite display sides, or a unit of three disks having three exposed display sides, is mounted on the shaft for selective display of said edge or any one of the display sides in a viewing position.

11 Claims, 3 Drawing Sheets

CHANGEABLE DOT DISPLAY ASSEMBLY

BACKGROUND OF THE INVENTION

1. Field of the Invention

This invention relates to the art of dot display assemblies, and more particularly concerns a changeable dot display assembly capable of assuming three different dot display positions, and useful as part of a large matrix of revolving disks which can serve as a variable message sign for a shopping mall, highway, theater, restaurant, or other public viewing installation.

2. Description of the Prior Art

Dot display assemblies now available are generally designed to present either one of two different display faces. These display assemblies utilize as a basic display element, a rotatable disk which is rotated 180 degrees by electromagnetic means actuated by appropriate electrical or electronic circuitry. The display disk usually has one black side and an opposite fluorescent colored side and carries a permanent magnet. When the display disks in a matrix are selectively turned to either one of their two viewing positions different messages may be exhibited. Such a prior dot assembly may have a stationary U-shaped magnetic core on the two legs of which each may have one coil. The coils are each one half of a single continuous coil. When electric current passes through the coil in one direction, the cores present magnetic poles of opposite polarity to an adjacent rotatable disk, to turn the disk to one display position. When the coil current is reversed in direction, the magnetic polarities of the legs of the core reverse to turn the display disk to its other, second display position 180 degrees from the previous position. This type of prior dot display assembly is not capable of turning the disk to a third dot display position, as is possible in the present invention.

SUMMARY OF THE INVENTION

It is highly desirable, expecially for advertising purpose, to provide a dot display assembly having three dot or disk display positions. The present invention employs a rotatable disk which is electromagnetically actuated to assume any selected one of three display positions. In two of the positions a dot of different colors may be exhibited. In the third position a background of another color may be exhibited. In another embodiment of the invention the rotatable disk has three dots or disks of different colors so that any one of the three dots of the display assembly may be selectively exhibited.

Both the single disk and three-disk dot display assemblies employ a stator having a pair of stationary, separate, magnetic cores with separate coils wound on each of the cores. Each assembly has a rotor including a rotary bar which carries a display disk or disks with a permanent magnet attached thereto. The coils may be connected to an external d.c. voltage source so arranged that the cores are independently magnetized to attract or repel the permanent magnet and thereby to turn the rotor of the dot display member or members to any selected one of the three possible display positions. A multiplicity of such dot display assemblies embodying the invention may be arranged in a matrix to exhibit changeable messages in different colors. The three position dot display assembly may be provided at a very slight increase in cost or even at no increase in cost over a dot display assembly capable of providing only two display positions.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENTS

Figure 1:
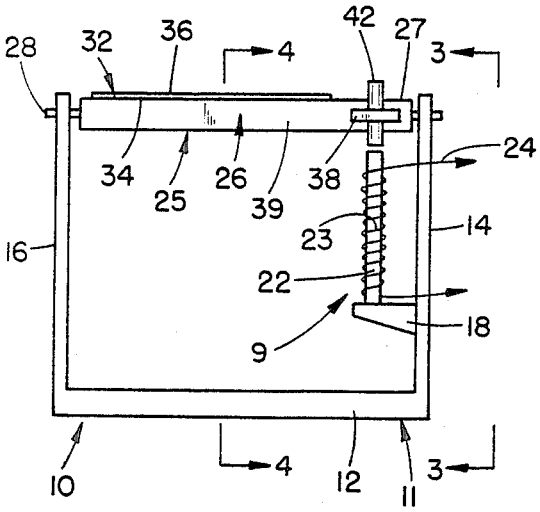
FIG. 1 is a side view of a dot display assembly employing a single display disk according to the invention.
Figure 2:
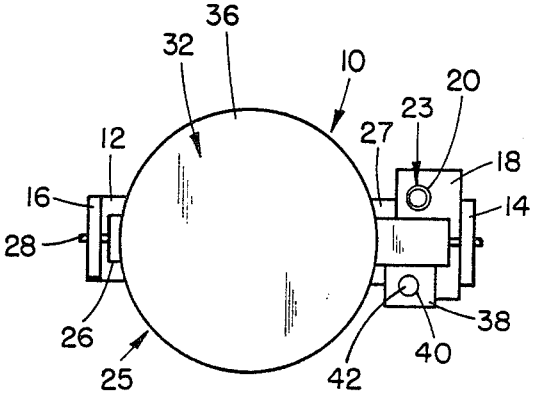
FIG. 2 is a top plan view of the dot display assembly of FIG. 1.
Figure 3:
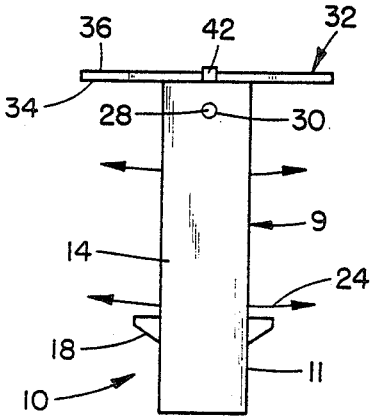
FIG. 3 is an end elevational view taken along line 3—3 of FIG. 1.

Referring now to the drawings wherein like reference characters designate like or corresponding parts throughout, there is illustrated in FIGS. 1–6 a dot display assembly generally designated as reference numeral 10 for a message sign matrix. The assembly 10 has a stator 9, including a stationary rectangular U-shaped stator frame 11 with a straight base 12, and two upright end walls 14, 16. On the inside of the end wall 14 is a bracket or platform 18 on which are mounted two stationary, straight magnetizable cores 20, 22 spaced about one half inch apart. The cores 20, 22 are disposed parallel to each other and are wound with identical wire coils 23 which coils may be wound with bifilar wire. Terminals 24 of the coils 23 are to be connected to appropriate external circuitry for operating the assembly 10.

The assembly 10 has a rotor 25 including a rectangular shaft or bar 26 provided with trunnions 28 at opposite ends thereof which are rotatably engaged in a respective hole 30 near free ends of the frame walls 14, 16. The bar 26 rotates on its longitudinal axis parallel to the base 12. Mounted on one side 27 of the bar 26 is a flat circular disk 32, one side 34 of which may be colored black or other ground color to provide background view, and the other side 36 of the disk 32 may have a different, color for use as part of a colored message in a matrix of similar assemblies. Near one end of the bar 26 is a flat fin or tab 38 extending from a side 39 parallel to the side 27 and to the disk 32. Secured in a hole 40 in the fin 38 is a short, straight, magnet 42 permanently magnetized with opposite N and S poles. The magnet 42 extends axially perpendicular to the side 27 of the bar 26 and parallel to the side 39. When the rotor 25 turns, the magnet 42 rotates in a plane which includes the central axes of both cores 20, 22.

Figure 15:
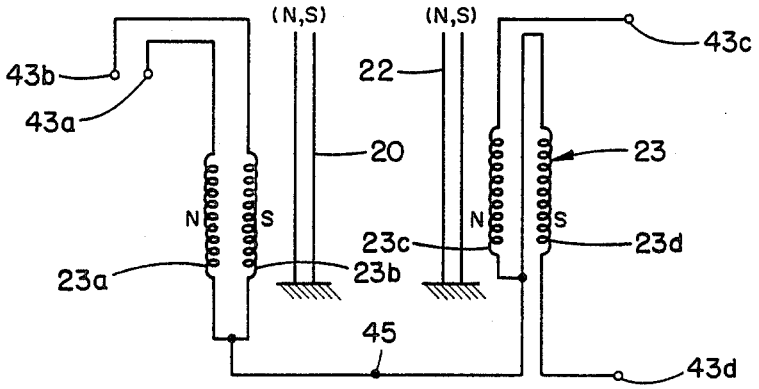
FIG. 15 is a circuit diagram of the cores and coils employed in the stators of the three dot display assemblies of FIGS. 1–14.

FIG. 15 shows the cores 20 and 22 and the coils 23 wound on them. It is preferred that the coils be wound with a bifilar winding. Windings 23*a*, 23*b* are wound on the core 20 and windings 23*c*, 23*d* are wound on the core 22. The coils 23 have terminals 43*a*, 43*b*, 43*c* and and 43*d* to which voltages of appropriate polarities are applied to magnetize the cores 20, 22 with desired polarity. One end of each coil is connected to a common junction point 45. When the terminal 43*a* is positive and the terminal 43*c* is negative, then the core 20 will have an N magnetic pole at its operative free end and the core 22 will also have an N magnetic pole at its operative free end. When the terminal 43*b* is positive and the terminal 43*d* is negative, then the core 20 will have an S magnetic pole at its free end and the core 22 will have an S pole at its free end. When the terminal 43*b* is positive and the terminal 43*c* is negative, then the core 20 will have an S pole at its free end and the core 22 will have an N pole at its free end.

Figure 4:
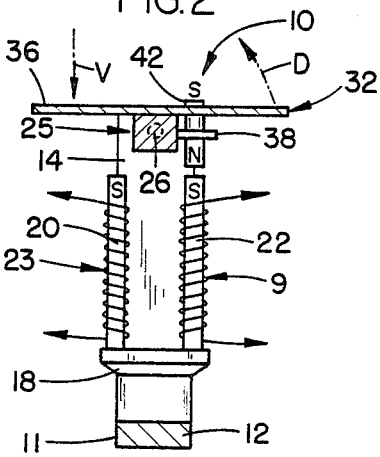
FIG. 4 is a vertical cross sectional view taken along line 4—4 of FIG. 1, showing the display disk in a first viewing position.

In operation of the dot display assembly 10 of FIGS. 1–6, when the free ends of both of the magnetic cores 20 and 22 have S polarity adjacent to rotor 25 as indicated in FIG. 4, the N pole of the magnet 42 will be attracted to the core 22 while the S pole of the magnet 42 will be repelled from the core 20. The display disk 32 will assume the position shown in FIG. 4 where the colored display side 36 faces outwardly in viewing position V. When the currents magnetizing the cores 20, 22 are cut off, the cores 20, 22 will remain magnetized to hold the rotor 25 stationary. When thereafter, the currents in the coils 23 are directed as explained above in connection with FIG. 15, so that the N poles of both of the cores 20, 22 are adjacent the rotor 25, the rotor 25 will turn counterclockwise 180 degrees in direction D to the reversed position shown in FIG. 5. Since the N poles of magnetized cores 20, 22 will be adjacent to the rotor 25, the N pole of the core 20 will attract the S pole of the magnet 42 while the N pole of the core 22 will repel the N pole of the magnet 42. Thus, the rotor will assume and remain in the position shown in FIG. 5 where the side 34 of the disk 32 is exposed outwardly in viewing position while the side 36 is concealed. If the currents in the coils 23 are cut off the cores 20, 22 will remain magnetized and the display disk and rotor will remain stationary in the position of FIG. 5. If the currents in the coils 23 is again reversed, the rotor 25 will turn clockwise 180 degrees in direction D′ to the position illustrated in FIG. 4 where the S pole of the core 22 again attracts the N pole of the magnet 42, while the S pole of the core 20 repels the S pole of the magnet 42.

Figure 5:
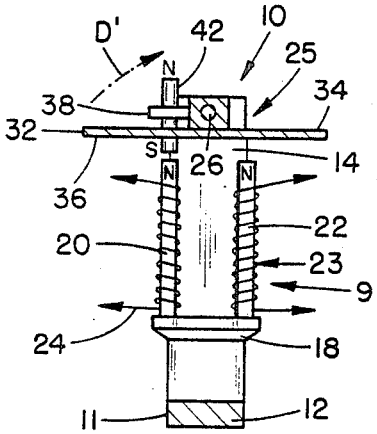
FIGS. 5 and 6 are sectional views similar to FIG. 4 showing the display disk in second and third viewing positions respectively.

The sides of bar or shaft 26 should be colored black or have the same ground color as the side 34 of the disk 32 to present a uniform appearance with the side 34 when it is exposed as shown in FIG. 5.

Figure 6:
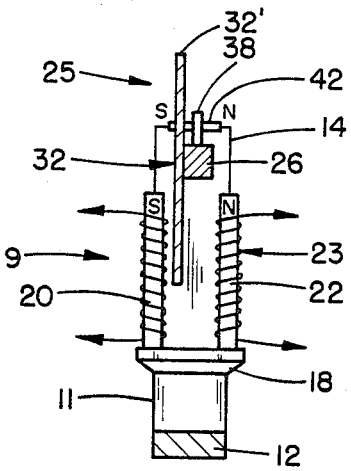

If the currents in the coils 23 are directed as explained in connection with FIG. 15 so that the poles of the cores 20, 22 adjacent the rotor 25 will assume different polarities, i.e. one pole will be an S pole and the other pole will be an N pole as shown in FIG. 6, then both poles of the rotor magnet 42 are repelled by the two cores 20, 22, and will cause the rotor 25 to turn 90 degrees so that the magnet 42 will be axially parallel to the cores 20, 22 and the disk 32 will be disposed in a plane parallel to the axes of the cores 20, 22 with an edge 32′ exposed. This constitutes a third display position of the assembly 10.

Figure 7:
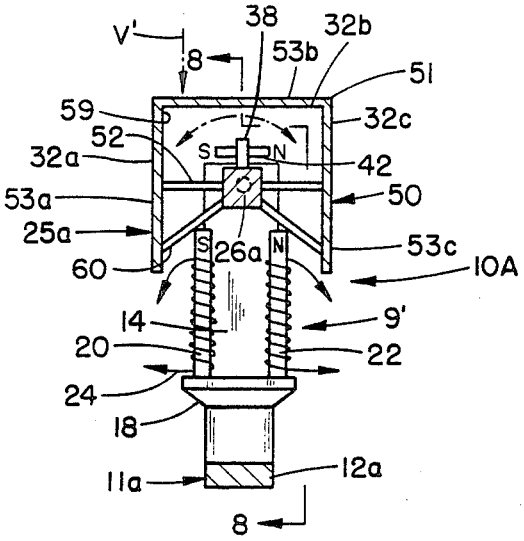
FIG. 7 is a vertical sectional view similar to FIGS. 4–6, of another dot display assembly having three dot display disks.
Figure 8:
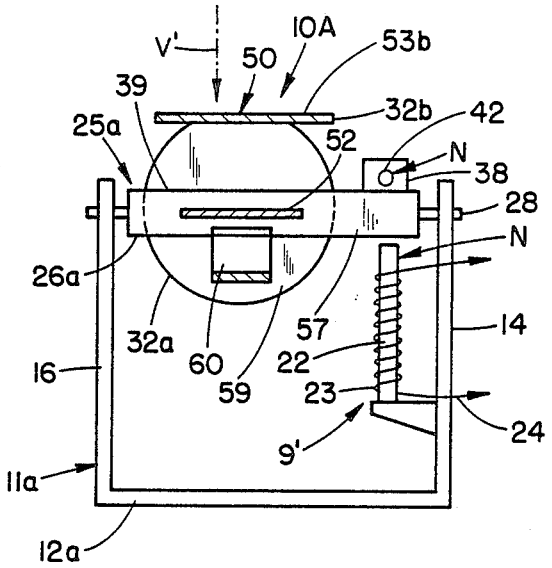
FIG. 8 is a vertical, longitudinal sectional view similar to a portion of FIG. 1, but taken along line 8—8 of FIG. 7.
Figure 9:
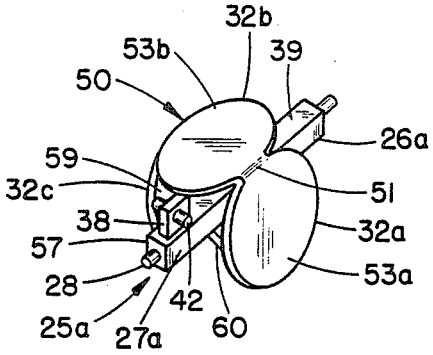
FIG. 9 is an isometric view of the rotor employed in the dot display assembly of FIGS. 7 and 8.
Figure 10:
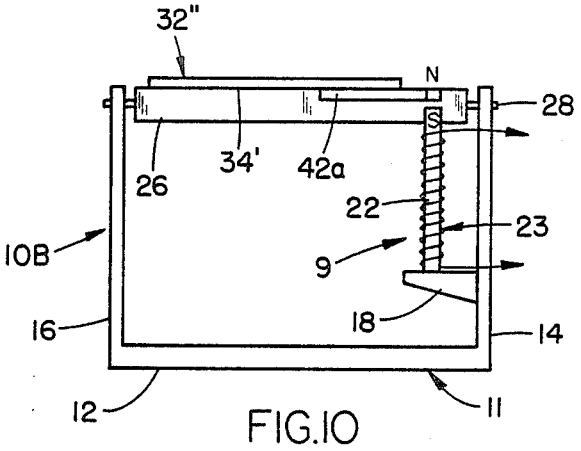
FIG. 10 is a side elevational view similar to FIG. 1, showing a dot display assembly embodying a modification of the invention.
Figure 11:
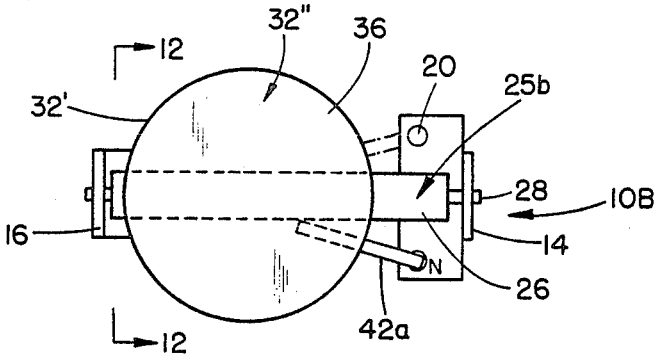
FIG. 11 is a top plan view of the dot display assembly of FIG. 10.

FIGS. 7 and 8 show a three-dot display assembly 10A which is similar in many respects to the assembly 10 of FIGS. 1–5, and corresponding parts are identically numbered. The stator 9′ has a rectangular U-shaped stator frame 11*a* with a pair of end walls 14, 16 joined to a base 12*a*. The stator 9′ carries a rotor 25*a* which is similar to the rotor 25, except that the disk 32 is replaced by three disks 32*a*, 32*b* and 32*c* arranged as a unit 50 which is rectangularly in an array U-shaped as shown in FIGS. 7, 8 and 9. The disks 32*a*, 32*b* and 32*c* can be integrally joined at bends 51. Stay bars or plates 52 extend outwardly from opposite sides 27*a* and 57 of a rotary bar 26*a*, and are secured to inner sides 49 of the disks 32*a*, 32*b* and 32*c*. The inner sides 59 are always concealed while the outers sides 53*a*, 53*b*, and 53*c* are the display sides of the rotary unit 50. Further stay bars or plates 60 are secured between the sides 27*a*, 57 of the rotary bar and inner end portions of disks 32*a*, 32*b*, and 32*c*. The disks 32 are preferably round or substantially so to present display dots when in viewing positions V′. The bar magnet 42 carried by the fin 38 is disposed on the side 39 of the bar 26*a* in the same manner as in the rotor 25. The three-disk rotor 25*a* is rotatable mounted by trunnions 28 on the end walls 14, 16 of frame 11*a* in the same manner as in assembly 10. The cores 20, 22 are mounted on the bracket or shelf 18 in the same manner as in the assembly 10. Identical coils 23 are wound on the cores 20, 22 for turning the rotor 25*a* when the coils arranged as shown in FIG. 15 are energized by external circuitry applied via terminals 43*a*, 43*b*, 43*c*, 43*d*.

FIGS. 7 and 8 show rotor 25*a* in the third or central viewing position of the rotor 25*a*. It will be noted that the free ends of cores 20, 22 adjacent to the rotor 25*a* are oppositely polarized with S and N poles respectively. This causes the magnet 42 to stabilize axially in a plane perpendicular to the axes of the cores 20, 22. The N pole of magnet 42 is repelled by the N pole of the core 22 while the S pole of the magnet 42 is repelled by the S pole of the core 20. When the rotor 25*a* initially turns to the central or third position shown in FIGS. 7 and 8, there may be some slight oscillation, but this will soon diappear or may not occur at all if the magnetization of the cores 20 and 22 is identical but opposite in direction, with the axes of the bar 26*a* midway between the cores. If the polarity of the cores 20, 22 is changed so that both S poles of the cores 20, 22 are adjacent the rotor 25*a* the magnet 42 will assume the position shown in FIG. 4, but display side 53*a* of disk 32*a* will be exposed and exhibited in viewing position V′. If the polarity of the poles 20, 22 is reversed so the ends of cores 20, 22 adjacent the rotor are both N poles (as in FIG. 5) the rotor 25*a* will turn 180 degree to expose side 53*c* of disk 32*c* in viewing position V′. If the polarity of the core 22 is changed to N and the polarity of the core 20 is changed to S, the rotor 25*a* will turn 90 degrees from either side position to the central position shown in FIGS. 7 and 8. It is preferred that in the central or third viewing position of the rotor, one core, for example, the core 22, always present an N pole while the other core 20 presents an S pole, so that the disk unit 50 will always assume the central position shown in FIG. 7, where the N pole of the magnet 42 is repelled by the N pole of the core 22 while the S pole of the magnet 42 is repelled equally by the S pole of the core 20.

It will be noted that the two-dot display assembly 10 of FIGS. 1–6 can easily and inexpensively be converted to the three-dot display assembly 10A of FIGS. 7 and 8, by simply replacing the flat disk 32 with the three-disk unit 50. The stators 9 and 9' are substantially identical.

When a multiplicity of display assemblies 10A are mounted in a matrix, the resulting message sign can display messages in two different colors for two of the display disks in their respective viewing positions, while the third disk displays a ground color in its viewing position.

The disk or dot display assembly 10B shown in FIGS. 11–14, has a rotor **25*b* which is similar to the rotors 25 and 25*a* of the dot display assemblies 10 and 10A. The magnet 42 and the fin 38 of the rotors 25 and 25*a* are replaced by a single permanent bar magnet 42*a* attached to one side 34' of the single round disk 32'' on the bar 26. The bar magnet 42*a* extends radially outward of the disk 32'' coplanar with the side 34'. The N pole of the magnet is offset from the edge 32' of the disk 32''. Other parts correspond to those of the rotor 25 and are identically numbered. The stator 9 of assembly 10B is identical to the stator 9 in assembly 10**.

Figure 12:
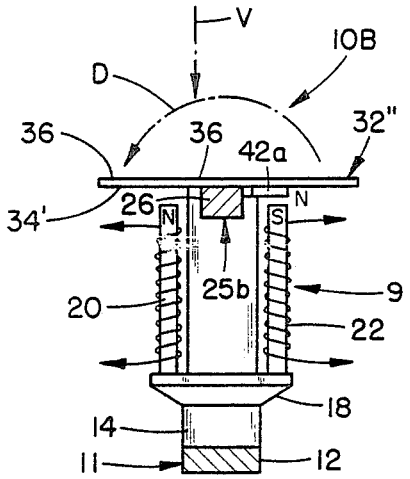
FIG. 12 is a cross sectional view taken along line 12—12 of FIG. 10, showing the rotor in one selected dot display position.
Figure 13:
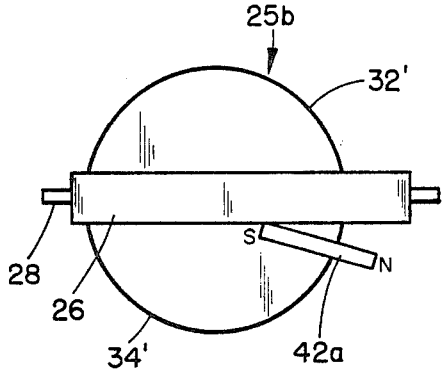
FIG. 13 is a bottom plan view of the rotor of the dot display assembly of FIGS. 10–12.
Figure 14:
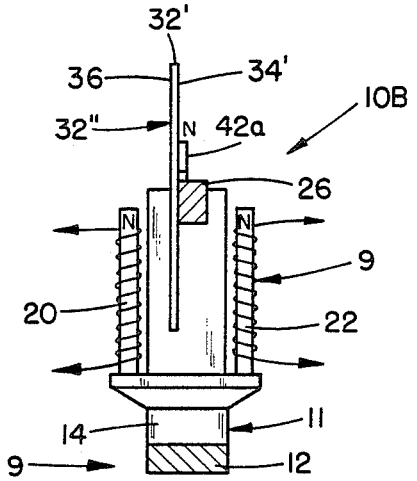
FIG. 14 is a cross sectional view similar to FIG. 12, showing the rotor in another dot display position.

FIG. 12 shows the disk 32'' exposing a colored side 36 in viewing direction V in the same manner as in FIG. 4. It will be noted that in this position, the magnetic cores 20 and 22 are magnetized with N and S poles respectively adjacent to the rotor **25*b*. This polarization of the poles is opposite from the S, N polarization of the poles shown in FIG. 6 for obtaining the center or edgewise position of the disk 32. Here, however, only the N pole of magnet 42*a* is used, and the S pole is remote from the cores 20, 22. The N and S polarization of the cores 20, 22 is obtained by making a terminal 43*a* of the coil 23*a*, shown in FIG. 15, positive and a terminal 43*d* of the coils 23*d* negative. If the magnetic polarization of the cores 20, 22 is reversed so that the S pole of the core 20 and the N pole of the core 22 (as shown in FIG. 6) are adjacent to the rotor 25*b*, the rotor 25*b*, will turn 180 degrees in a direction D to expose the side 34' in viewing position. If both of the cores 20 and 22 are polarized with N poles adjacent the rotor 25*b* as shown in FIG. 14, they will equally repel the N pole of the magnet 42*a*, and the rotor 25*b* will assume the third or central position where the disk 32'' is disposed parallel to the cores 20, 22, and the edge 32' is exposed in viewing position V. This central position will expose no color and corresponds to the central position of the rotor 25*a* shown in FIGS. 7 and 8**.

It will be noted that no structural change is required in the stator 9 to obtain rotation of the rotor **25*b* to the three positions of the dot display assembly 10B. The only change in operation is in the way the magnetizing voltages are applied to the coils 23 as explained above with reference to FIG. 15. The three position assembly 10 can easily and inexpensively be converted to the construction of assembly 10B simply by replacing magnet 42 with magnet 42*a***. This conversion or change will effect a saving in cost of assembly and reduction in the number and size of parts.

A multiplicity of assemblies 10B can be mounted in a matrix to display dots in two different colors for opposite sides of the display disk 32'', while the disks in edgewise position present no color or blackness for background effect.

Although the rotor 25 has been illustrated as having the side **53*a* perpendicular to the side 53*b*, and the side 53*c* also perpendicular to the side 53*b*, in practice in order to insure that only one side is visible in the viewing position, the sides 53*a* and 53*c* may each be at an external angle with side 53*b* of more than 90 degrees i.e. 102 degrees. In this event the rotor 25 must rotate 102 degrees to expose any other side. The angle at which the rotor 25 is stopped may be set by a stop fixed to the end walls 14,16**.

It should be understood that the foregoing relates to only a limited number of preferred embodiments of the invention which have been by way of example only and that it is intended to cover all changes and modifications of the example of the invention herein chosen for the purpose of the disclosure, which do not constitute departures from the spirit and scope of the invention.

What is claimed is:

1. A changeable dot display assembly for a portion of a matrix of dots in a variable message sign, comprising:

a stationary support;

a pair of substantially parallel reversely magnetizable magnetic core means carried by said support in an axial position;

wire coil means wound on said core means to magnetize the same when said coil means are electrically energized; and a rotor carried by said support, said rotor comprising:

a shaft mounted to rotate on an axis perpendicular to and axially spaced from said core means and midway thereinbetween a permanent magnet mounted to rotate with said shaft, said magnet having at least one magnetic pole axially positioned from said core means and disposed for attraction and repulsion by magnetized ends of at least one of said core means when said core means are magnetized by said coil means to rotate said rotor selectively to three different positions with respect to a viewing position, two of said three positions being substantially 180 degrees apart and the third position lying between said two positions; and dot display means carried by said shaft, said display means having areas of different colors for selective display in said viewing position depending on the polarities of said ends of said core means when magnetized.

2. A changeable dot display assembly as defined in claim 1, wherein said coils are each independent of each other for selectively magnetizing said cores.

3. A changeable dot assembly as defined in claim 1, wherein said dot display means is a flat disk having opposite sides and peripheral edge selectively disposed in said viewing position, whereby said shaft is rotated in one direction to stop at a first place where one of said sides of said disk is exposed in said viewing position when said polarized ends of said cores have a first polarized array, whereby said shaft is rotated in an opposite direction substantially 180 to stop at a second place where the other side of said disk is exposed in said viewing position when said polarized ends of said cores have a second polarized array, and whereby said shaft is rotated in either direction to stop at a third place between said first place and said second place where said edge of said disk is exposed in said viewing position when said polarized ends of said cores have a third polarized array.

4. A changeable display assembly as defined in claim 3, wherein said permanent magnet is mounted to dispose just one magnetic pole thereof adjacent said ends of said cores for selectively exposing said sides and said edge of said disk when said polarized array of said cores changes.

5. A changeable display assembly as defined in claim 4, further comprising a member secured to and extending from one side of said shaft adjacent said cores, said permanent magnet being carried by said member to rotate in a plane parallel to said axes of said cores to expose opposite poles of said magnet for interaction with said polarized ends of said cores.

6. A changeable display assembly as defined in claim 3, wherein said permanent magnet is disposed to rotate in a plane parallel to said axes of said cores, so that said shaft rotates selectively in two equal steps to expose one of said sides and said edge of said disk selectively in said viewing position each time said polarized array of said cores changes.

7. A changeable dot assembly as defined in claim 1, wherein said dot display means comprises a display unit having three display sides respectively disposable in a display viewing position, a first one of said display sides being displayed in said viewing position when said polarized ends of said cores both have one polarized array, a second one of said display sides being displayed in said viewing position when said polarized ends of said cores both have a second polarized array, and a third one of said display sides being displayed in said viewing position when said polarized ends of said cores have a third polarized array.

8. A changeable dot display assembly as defined in claim 7, wherein said display unit comprises three disks, and wherein said display sides have different colors for selective display thereof in said viewing position.

9. A changeable display assembly as defined in claim 7, wherein said permanent magnet is disposed to rotate in a plane parallel to said axes of said cores, so that said shaft rotates selectively to one of two other angular positions depending on the magnetic polarities of said ends of said cores, for selectively displaying any one of said three display sides in said viewing position.

10. A changeable display assembly as defined in claim 7, wherein said disks are integrally joined at adjacent edges, and further comprising support members connected between said shaft and opposite inner sides of said disks to mount said display unit rigidly on said shaft.

11. A changeable display assembly as defined in claim 10, further comprising a member secured to and extending from one side of said shaft adjacent said cores, said permanent magnet being carried by said member to rotate in a plane parallel to said axes of said cores to dispose opposite poles of said magnet for interaction with said polarized ends of said cores.

* * * * *